US010934773B2

(12) United States Patent
Lemaitre et al.

(10) Patent No.: US 10,934,773 B2
(45) Date of Patent: Mar. 2, 2021

(54) MOTORIZED MANOEUVRING DEVICE INTENDED TO MANOEUVRE A MOVING WINDABLE FABRIC SCREEN OF A WINDOW OR PROJECTION SCREEN COVER DEVICE

(71) Applicant: SOMFY SAS, Cluses (FR)

(72) Inventors: Sébastien Lemaitre, Cluses (FR); Julien Peillex, Cluses (FR); Ronan Georgeault, Cluses (FR)

(73) Assignee: SOMFY ACTIVITES SA, Cluses (FR)

( * ) Notice: Subject to any disclaimer, the term of this patent is extended or adjusted under 35 U.S.C. 154(b) by 0 days.

(21) Appl. No.: 14/755,688

(22) Filed: Jun. 30, 2015

(65) Prior Publication Data

US 2015/0300088 A1 Oct. 22, 2015

Related U.S. Application Data

(63) Continuation-in-part of application No. 14/408,040, filed as application No. PCT/EP2013/062300 on Jun. 13, 2013.

(30) Foreign Application Priority Data

Jun. 13, 2012 (FR) ..... 1255524

(51) Int. Cl.
*E06B 9/72* (2006.01)
*E06B 9/64* (2006.01)
*E06B 9/42* (2006.01)

(52) U.S. Cl.
CPC ..... *E06B 9/72* (2013.01); *E06B 9/42* (2013.01); *E06B 9/64* (2013.01)

(58) Field of Classification Search
CPC ..... E06B 9/72; E06B 9/74; E06B 9/56; E06B 9/54; E06B 9/50; E06B 9/42; E06B 9/40; E06B 9/32; E06B 9/322; E06B 9/174
(Continued)

(56) References Cited

U.S. PATENT DOCUMENTS 3,998,516 A 12/1976 Mabuchi
4,265,320 A * 5/1981 Tanaka ..... B25B 23/147 173/178
(Continued)

FOREIGN PATENT DOCUMENTS

DE 40 38 419 A1 6/1991
DE 4038419 A1 * 6/1991 ..... E06B 9/64
(Continued)

OTHER PUBLICATIONS

International Search Report and Written Opinion dated Jul. 31, 2013 issued in corresponding parent application No. PCT/EP2013/062300, U.S. Appl. No. 14/403,040; with English partial translation and partial machine translation (16 pages).
(Continued)

*Primary Examiner* — Johnnie A. Shablack
*Assistant Examiner* — Jeremy C Ramsey
(74) *Attorney, Agent, or Firm* — Seckel IP, PLLC

(57) ABSTRACT

A motorized maneuvering device (1) intended to manoeuvre a moving windable fabric screen (3), the motorized maneuvering device includes an actuator (4), comprising a hollow housing (41) containing a gear motor and a mounting end-plate (7*a*) which has a first support (11) extending from the end-plate along a first longitudinal axis (X-X') and cooperating with the housing (41) of the actuator (4) and a second support (12) extending from the end-plate along a second axis distinct from the first axis (Ya-Ya', Z-Z'). The hollow housing, notably the tubular hollow housing, of the actuator, is closed by the first end-plate support.

30 Claims, 8 Drawing Sheets

(58) Field of Classification Search
USPC ..... 160/310; 248/266
See application file for complete search history.

(56) References Cited

U.S. PATENT DOCUMENTS

| | | | | |
|---|---|---|---|---|
| 4,615,371 | A | 10/1986 | Clauss | |
| 4,997,022 | A | 3/1991 | Klein | |
| 5,029,629 | A | 7/1991 | Cheng-Pei | |
| 5,148,849 | A | 9/1992 | Faludy | |
| 6,060,852 | A | 5/2000 | Domel et al. | |
| 6,158,563 | A | 12/2000 | Welfonder et al. | |
| 6,189,592 | B1 | 2/2001 | Domel | |
| 6,421,175 | B1 | 7/2002 | Shopp | |
| 6,628,029 | B2 | 9/2003 | Astegno | |
| 6,843,301 | B2 * | 1/2005 | Carrillo | E04F 10/0614 160/310 |
| 6,979,962 | B2 | 12/2005 | Cavarec et al. | |
| 7,057,360 | B1 | 6/2006 | Hsu | |
| 7,231,953 | B2 | 6/2007 | Varley et al. | |
| 7,234,503 | B2 | 6/2007 | Kwak | |
| 7,237,592 | B2 | 7/2007 | Arnoux et al. | |
| 7,549,458 | B2 | 6/2009 | Kwak | |
| 7,686,061 | B2 | 3/2010 | Mullet et al. | |
| 7,690,694 | B2 | 4/2010 | Poder | |
| 7,723,939 | B2 * | 5/2010 | Carmen, Jr. | H02K 11/022 318/16 |
| 7,816,028 | B2 | 10/2010 | Rivetta | |
| 7,830,600 | B2 | 11/2010 | Jiang | |
| 8,004,224 | B2 | 8/2011 | Marchetto et al. | |
| 8,009,433 | B2 * | 8/2011 | Ares | E06B 9/72 361/730 |
| 8,258,993 | B2 | 9/2012 | Inoue et al. | |
| 8,307,878 | B2 | 11/2012 | Faller et al. | |
| 8,368,328 | B2 | 2/2013 | Mullet et al. | |
| 8,371,358 | B1 | 2/2013 | Mullet et al. | |
| 8,464,776 | B2 | 6/2013 | Anthoine | |
| 8,513,845 | B2 | 8/2013 | Angelini | |
| 8,575,872 | B2 | 11/2013 | Mullet et al. | |
| 8,659,246 | B2 | 2/2014 | Mullet et al. | |
| 8,662,139 | B2 | 3/2014 | Anthony et al. | |
| 8,723,454 | B2 | 5/2014 | Skinner et al. | |
| 8,739,854 | B2 | 6/2014 | Mullet et al. | |
| 8,776,861 | B2 | 7/2014 | Bohlen et al. | |
| 8,800,633 | B2 | 8/2014 | Mullet et al. | |
| 8,807,196 | B2 | 8/2014 | Mullet et al. | |
| 8,919,419 | B2 | 12/2014 | Mullet et al. | |
| 8,944,138 | B2 | 2/2015 | Feldstein et al. | |
| 8,960,260 | B2 | 2/2015 | Anderson et al. | |
| 9,018,868 | B2 | 4/2015 | Lucas et al. | |
| 9,054,541 | B2 | 6/2015 | Morita et al. | |
| 9,095,908 | B2 | 8/2015 | Mullet et al. | |
| 9,334,688 | B2 | 5/2016 | Colson et al. | |
| 10,031,305 | B2 * | 7/2018 | Leeman | G02B 6/4452 |
| 2003/0015301 | A1 | 1/2003 | Killo et al. | |
| 2004/0129849 | A1 * | 7/2004 | Walker | E06B 9/72 248/266 |
| 2005/0072532 | A1 | 4/2005 | Holden et al. | |
| 2005/0087313 | A1 | 4/2005 | Nichols, Jr. et al. | |
| 2005/0205216 | A1 | 9/2005 | Vrielink | |
| 2005/0225269 | A1 | 10/2005 | Barak | |
| 2006/0086874 | A1 | 4/2006 | Habel et al. | |
| 2006/0137837 | A1 | 6/2006 | Costello et al. | |
| 2006/0232234 | A1 * | 10/2006 | Newman, Jr. | E06B 9/72 318/280 |
| 2007/0155236 | A1 * | 7/2007 | Shi | H02G 3/32 439/587 |
| 2008/0067278 | A1 | 3/2008 | Fortunato et al. | |
| 2008/0212294 | A1 | 9/2008 | Ares | |
| 2008/0230192 | A1 | 9/2008 | Kane | |
| 2009/0310264 | A1 | 12/2009 | Cooper et al. | |
| 2010/0078137 | A1 | 4/2010 | Angelini | |
| 2010/0175838 | A1 | 7/2010 | Faller et al. | |
| 2010/0200176 | A1 | 8/2010 | Magli | |
| 2010/0219306 | A1 | 9/2010 | Detmer et al. | |
| 2010/0269988 | A1 | 10/2010 | Mullet et al. | |
| 2010/0282890 | A1 * | 11/2010 | Ducornetz | E06B 9/174 242/404 |
| 2011/0048655 | A1 | 3/2011 | Andreasen et al. | |
| 2011/0203748 | A1 | 8/2011 | Mullet et al. | |
| 2011/0265958 | A1 | 11/2011 | Skinner et al. | |
| 2012/0031571 | A1 | 2/2012 | Mullet et al. | |
| 2013/0099714 | A1 | 4/2013 | Mullet et al. | |
| 2013/0105095 | A1 | 5/2013 | Anderson et al. | |
| 2013/0199735 | A1 | 8/2013 | Colson et al. | |
| 2013/0220560 | A1 | 8/2013 | Mullet et al. | |
| 2013/0269885 | A1 | 10/2013 | Cavarec et al. | |
| 2013/0276995 | A1 | 10/2013 | Mullet et al. | |
| 2013/0285580 | A1 | 10/2013 | Mullet et al. | |
| 2013/0312920 | A1 * | 11/2013 | Mullet | E06B 9/40 160/310 |
| 2014/0014281 | A1 | 1/2014 | Mullet et al. | |
| 2014/0069595 | A1 | 3/2014 | Chen | |
| 2014/0076508 | A1 | 3/2014 | Mullet et al. | |
| 2014/0130989 | A1 | 5/2014 | Chan et al. | |
| 2014/0133019 | A1 | 5/2014 | Mullet et al. | |
| 2014/0224437 | A1 * | 8/2014 | Colson | E06B 9/42 160/291 |
| 2014/0262067 | A1 | 9/2014 | Higgins et al. | |
| 2014/0329034 | A1 | 11/2014 | Taylor et al. | |
| 2014/0352893 | A1 | 12/2014 | Malott | |
| 2015/0034258 | A1 | 2/2015 | Bohlen et al. | |
| 2015/0034259 | A1 | 2/2015 | Bohlen et al. | |
| 2015/0034260 | A1 | 2/2015 | Blair et al. | |
| 2015/0075732 | A1 | 3/2015 | Kirby et al. | |
| 2015/0136338 | A1 | 5/2015 | Lemaitre et al. | |
| 2015/0179994 | A1 | 6/2015 | Lemaitre et al. | |
| 2015/0191973 | A1 | 7/2015 | Bohlen | |
| 2015/0209525 | A1 | 7/2015 | Bicknell et al. | |
| 2015/0364960 | A1 | 12/2015 | Arimatsu | |
| 2017/0006740 | A1 * | 1/2017 | Holt | E06B 9/72 |
| 2017/0241201 | A1 * | 8/2017 | Buccola, Jr. | E06B 9/44 |
| 2018/0106105 | A1 * | 4/2018 | Anthony | E06B 9/72 |
| 2019/0106938 | A1 * | 4/2019 | Foley | E06B 9/72 |

FOREIGN PATENT DOCUMENTS

| | | | | |
|---|---|---|---|---|
| DE | 298 18 023 | U1 | 12/1998 | |
| DE | 102004016417 | B3 | 10/2005 | |
| DE | 10 2012 003 592 | A1 | 8/2013 | |
| EP | 0 911 479 | A2 | 4/1999 | |
| EP | 1365101 | A2 | 11/2003 | |
| EP | 1898042 | A2 * | 8/2007 | E06B 9/72 |
| EP | 1939390 | A2 * | 7/2008 | E06B 9/72 |
| EP | 1939390 | A2 | 7/2008 | |
| EP | 1961910 | A1 | 8/2008 | |
| EP | 2148412 | A1 * | 1/2010 | E06B 9/174 |
| FR | 2901304 | A1 | 11/2007 | |
| KR | 20100118723 | A | 11/2010 | |
| RU | 2418935 | C2 | 5/2011 | |
| WO | 2010/101495 | A1 | 9/2010 | |
| WO | 2011/150412 | A1 | 12/2011 | |
| WO | 2012/085252 | A1 | 6/2012 | |

OTHER PUBLICATIONS

Office Action dated Oct. 7, 2016 issued in co-pending U.S. Appl. No. 14/408,047; with PTO-892; without returned SB08 (12 pages) (US20130099714 and US20120031571 cited in the Office Action are not listed in this IDS since they are listed in other IDS forms submitted concurrently in this application).

European Search Report and Written Opinion dated Jun. 13, 2016 issued in European application No. EP15174484 corresponding to co-pending CIP U.S. Appl. No. 14/755,688; with English partial translation and partial machine translation (19 pages) (documents 1-4 cited in the ESR are not listed in this IDS since they were cited in the ISR and listed in the IDS filed Dec. 15, 2014 in this application).

Office Action dated Aug. 26, 2016 issued in co-pending U.S. Appl. No. 14/408,040; with PTO-892; without returned IDS forms SB08 (19 pages) (US20130199735; US20130269885 cited in the Office Action are not listed in this IDS since they were already listed in the IDS filed Jun. 30, 2015 in this application).

(56) References Cited

OTHER PUBLICATIONS

Office Action dated Aug. 30, 2017 in co-pending U.S. Appl. No. 14/408,040; with PTO-892; without returned IDS forms SB08 (19 pages) (US20100282890 and US20080212294 cited in the Office Action are not listed in this IDS since they were already listed in the IDS filed Dec. 27, 2016 in this application).

Office Action dated Oct. 18, 2018 in co-pending U.S. Appl. No. 14/408,040; with PTO-892; without returned SB08 (12 pages).

Office Action dated May 30, 2019 in co-pending U.S. Appl. No. 14/408,040; with PTO-892; without returned IDS forms SB08 (13 pages) (US20070155236 and EP1939390 cited in the Office Action are not listed in this IDS since they were already listed in the IDS filed Dec. 27, 2016).

International Search Report and Written Opinion dated Jul. 23, 2013, issued in co-pending application No. PCT/EP2013/062297, U.S. Appl. No. 14/408,047; with English partial translation and partial machine translation (16 pages).

Office Action dated Jul. 27, 2015 issued in co-pending U.S. Appl. No. 14/408,047; with PTO-892; without returned IDS forms SB08 (17 pages) (now U.S. Pat. No. 6,843,301; US20130312920; US20140224437 cited in the Office Action are not listed in this IDS since they were previously cited in the Office Action dated Jul. 26, 2016 in this application; US20130199735; US20130269885 cited in the Office Action are not listed in this IDS since they were previously cited in the IDS filed Jun. 30, 2015 in this application; now U.S. Pat. No. 8,659,246; US20150136338 cited in the Office Action is not listed in this IDS form since it is listed in an IDS form submitted concurrently in this application.

Final Office Action dated Mar. 4, 2016 issued in co-pending U.S. Appl. No. 14/408,047; with PTO-892 (16 pages) (US20120031571 cited in the Office Action is not listed in this IDS form since it is listed in an IDS form submitted concurrently in this application).

Advisory Action dated Jul. 13, 2016 issued in co-pending U.S. Appl. No. 14/408,047 (4 pages).

* cited by examiner

MOTORIZED MANOEUVRING DEVICE INTENDED TO MANOEUVRE A MOVING WINDABLE FABRIC SCREEN OF A WINDOW OR PROJECTION SCREEN COVER DEVICE

The invention relates to a moving windable fabric screen installation, of the window or projection screen cover type, provided with a motorized winding element. The invention relates more specifically to a motorized maneuvering device intended to manoeuvre a movable windable fabric screen of a window or projection screen cover device and to a window or projection screen cover device comprising such a maneuvering device. The invention notably relates to a motorized home automation system for maneuvering a moving screen in a conventional mounting configuration for which the winding shaft has to be kept in a fixed position relative to a frame and to a motorized maneuvering home automation system for an inverse-mounted screen, in which the winding shaft is suspended on the fabric and therefore can be moved relative to its bearing structure (building or moving structure such as a load bar or an arm of an awning).

Such a screen is described in the patent application PCT/EP11073888 (published as WO2012085252A1). In this application, the motorized manoeuvring device is intended to be suspended by the fabric and comprises:

- a winding tube that moves about a first axis and on which the fabric is intended to be wound,
- an actuator arranged at least partially in the tube,
- a first means for fixing a first end of the fabric to the winding tube.

The weight of the manoeuvring device creates a fabric unwinding torque. The device comprises an unwinding torque neutralizing means that acts exclusively by interaction with gravity and/or with the fabric. This neutralizing means notably comprises a torque recovery bar mounted between two lateral end-plates.

In the different types of screens, the actuator is mounted inside the winding tube. The output shaft of the actuator drives the winding tube in rotation when the motor of the actuator is powered.

The actuator comprises a hollow tubular housing, closed by a part called head of the actuator. The latter is conventionally fixed onto an accessory that is itself added onto a frame, an end-plate or on a side of a casing. The winding shaft is kept free to rotate on the actuator, notably on a portion of tubular housing of the actuator.

The aim of the invention is to provide a moving screen maneuvering device that improves the maneuvering devices known from the prior art. In particular, the invention proposes a maneuvering device of simple and compact architecture, involving a support element that is simple, reliable and versatile. The aim of the invention is also to provide a moving screen maneuvering device in which the actuator is incorporated without accessories, the device itself acting as actuator head. Moreover, another aim of the invention is to provide a support element that can suit different tube-based or winding shaft-based home automation system architectures.

According to an aspect of the invention, a motorized maneuvering device is intended to manoeuvre a moving windable fabric screen. The motorized maneuvering device comprises:

- an actuator, comprising a hollow housing containing a gear motor,
- an end-plate.

The end-plate comprises a first support extending from the end-plate along a first longitudinal axis and cooperating with the housing of the actuator.

The end-plate comprises a second support extending from the end-plate along a second axis distinct from the first.

The first support can comprise at least one first rotation stopping element, notably at least one groove, respectively at least one rib, in particular at least one first rotation stopping element formed on a shafted part of the first support. The housing can comprise at least one second rotation stopping element, notably at least one rib, respectively at least one groove, in particular at least one second rotation stopping element formed on inner walls of the housing. The first and second rotation stopping elements cooperate to link in rotation, notably to link in rotation about the first longitudinal axis, the first support and the housing.

The end-plate and its first and second supports can be produced as a single piece.

The first support can be at least partially inserted into the hollow housing of the actuator.

The hollow housing, notably the tubular hollow housing, of the actuator can be closed by the first end-plate support.

The second support can be intended to cooperate with a torque neutralizing element acting by interaction with the fabric.

The second support can be intended to cooperate with a frame on an axis substantially at right angles to the longitudinal axis of the first support.

The end-plate can comprise a first bore intended to receive a connection and/or electronic part of the actuator, the first bore being produced inside the first support.

The end-plate can comprise a second bore on its outer lateral face and a cover intended to close this bore.

The first and the second bores of the end-plate can be connected to one another.

The end-plate can comprise a through hole between the second bore and its inner lateral face, the hole emerging outside the diameter of the hollow housing of the actuator for the entry of a cable.

A first guiding path for an electrical wire can be positioned in the second bore.

The inner lateral face of the end-plate can comprise a second guiding path for an electrical wire.

The two supports can extend from the inner lateral face of the end-plate.

The motorized device can comprise an annular surface on the inner lateral face of the end-plate against which a bearing ring mounted free to rotate about the housing of the actuator can bear.

According to an aspect of the invention, a motorized home automation system comprises a motorized device as defined previously, a bearing ring rotating freely on the housing of the actuator, a winding tube, mounted to slide on the bearing ring, the bearing ring bearing on the inner face of the end-plate and a second end-plate comprising a winding tube support element.

According to another aspect of the invention, an end-plate for a radio controlled motorized maneuvering device comprises:

- a first guiding path formed by a groove in the end-plate, the first guiding path being shaped for receiving and holding a radio antenna.

In other embodiments:

- the end-plate comprises a second guiding path formed by a groove in the end-plate, the second guiding paths being shaped for receiving and holding part of a radio antenna;

the first and second guiding paths have a first common end and second ends;

the first guiding path comprises a part which extends in whole or in part along a perimeter of the outer face.

According to another aspect of the invention, a motorized maneuvering device for maneuvering a moving element comprises such an end-plate and a radio antenna.

According to another aspect of the invention, a method of configuring a motorized maneuvering device comprises the following steps:

providing a motorized maneuvering device for maneuvering a moving element, the motorized maneuvering device comprising an such end-plate and a radio antenna;

removing the radio antenna from the first guiding path and shaping and setting the radio antenna in a different configuration.

According to another aspect of the invention, a method of configuring a motorized maneuvering device comprises the following steps:

providing a motorized maneuvering device for maneuvering a moving element, the motorized maneuvering device comprising an such end-plate and a radio antenna;

removing the radio antenna from the first guiding path and shaping and setting the radio antenna in the second guiding path.

According to another aspect of the invention, a motorized maneuvering device for maneuvering a moving windable fabric screen comprises:

an actuator, comprising a hollow housing containing a motor and a gear;

a mounting end-plate, the end-plate comprises a first support extending from the inner lateral face of the end-plate along a first longitudinal axis, the hollow housing, notably the tubular hollow housing, of the actuator being closed by the first end-plate support, wherein the end-plate comprises a first guiding path for an electrical wire in a bore on a outer lateral face of the end-plate.

In other embodiments:

the first support comprises at least one first rotation stopping element, notably at least one groove, respectively at least one rib, in particular at least one first rotation stopping element formed on a shafted part of the first support and in that the housing comprises at least one second rotation stopping element, notably at least one rib, respectively at least one groove, in particular at least one second rotation stopping element formed on inner walls of the housing, the first and second rotation stopping elements cooperating to link in rotation, notably to link in rotation about the first longitudinal axis, the first support and the housing;

the actuator comprises a radio receiver and in that the guiding path permits to store therein an antenna wire;

the guiding path takes the form of pins arranged facing one another and between which a part of the antenna wire can be wedged;

the end-plate comprises a cover intended to close the bore on the outer lateral face;

the actuator comprises inside the hollow housing electromechanical components such as the motor, the gear, a control electronic;

the end-plate comprises a bore intended to receive a connection and/or electronic part of the actuator, said bore being produced inside the first support;

the bore on the outer face of the end-plate and the bore produced inside the first support are connected to one another;

the end-plate comprises a through hole between the bore produced inside the first support and its inner lateral face for the entry of a cable, notably for the entry of a power supply cable;

the motorized device comprises an annular surface on the inner lateral face of the end-plate against which a bearing ring mounted free to rotate about the housing of the actuator can bear, and the first support cooperates with the housing of the actuator and in that it comprises a second support extending from the end-plate along a second axis distinct from the first.

According to another aspect of the invention, a motorized home automation system comprises such a motorized device, a bearing ring rotating freely on the housing of the actuator, a winding tube, mounted to slide on the bearing ring, the bearing ring bearing on the inner face of the end-plate and a second end-plate comprising a winding tube support element; the system comprising a radio-receiver and a power supply device of the actuator comprising an electrical energy storage element.

In particular, the maneuvering actuator is inserted into the winding tube, at one of its ends, whereas the power supply device is inserted into the winding tube, at its other end.

Advantageously, the end-plate is fixed onto an accessory that is itself added onto a frame or on a side of a casing.

The invention will be better understood on reading the following description, given purely as an example and with reference to the attached drawings in which.

Figure 1:
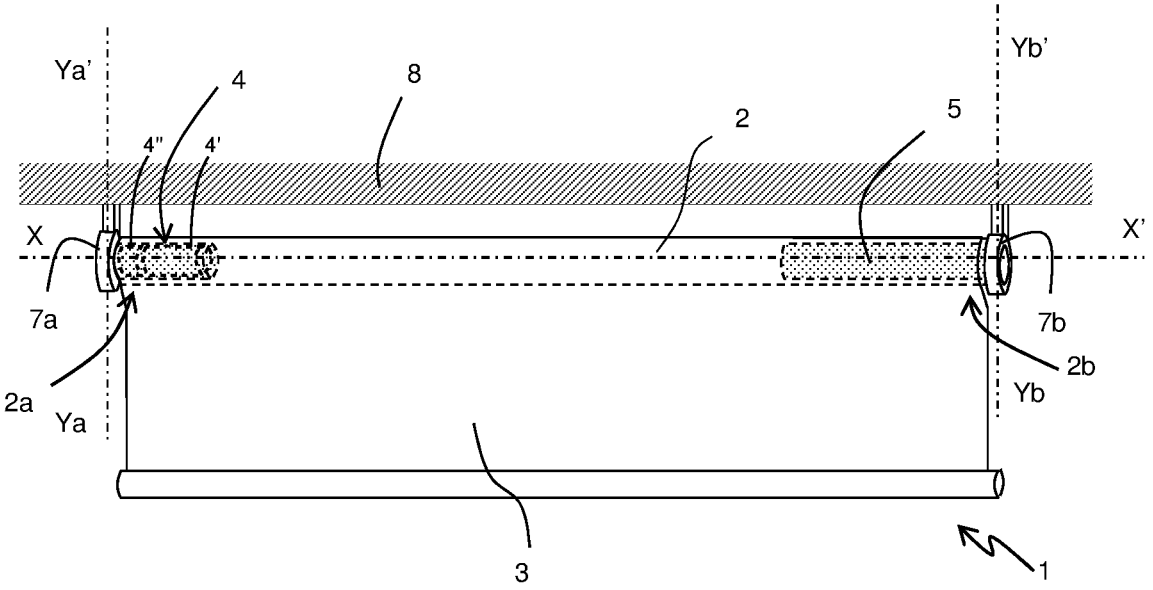
FIG. 1 is a representation of a first embodiment of a motorized home automation system for maneuvering a moving screen in a conventional mounting configuration.

An embodiment of a motorized maneuvering home automation system, represented in FIG. 1, allows for the motorized maneuvering of a moving screen 3, notably a screen that can be wound about a winding tube 2, such as a blind.

It is notably designed to be used to block or restrict the penetration of sunlight through an opening of a building.

The home automation system or motorized screen system comprises a winding tube maneuvering actuator 4. This actuator is preferably arranged partially or totally in the winding tube. The maneuvering actuator is said to be standalone, that is to say that it is powered by its own power supply device 5 comprising an electrical energy storage element 6. The maneuvering actuator is inserted into the winding tube, at one of its ends, whereas the power supply device is inserted into the winding tube, at its other end.

The actuator sets the winding tube in motion in a known manner. The moving screen is attached by one of its ends to the tube. Thus, the rotation of the winding tube causes, depending on its direction, the screen to be wound onto or unwound from the tube. The actuator and the winding tube extend along a first axis X-X'.

The system 1 comprises two end-plates 7*a*, 7*b* on either side of the winding tube. These end-plates are used to hold the motorized screen system on a fixed structure or frame 8, for example a ceiling or a wall. In particular, the end-plates 7*a* and 7*b* support the winding tube on two axes Ya-Ya' and Yb-Yb', parallel to one another and at right angles to the first axis X-X'. Other configurations are also possible. In this first embodiment, the winding tube remains fixed (excluding its rotation about its axis X-X') relative to the structure of the building and the fabric is wound around this winding tube. The end-plate 7*a* close to the actuator is called first end-plate or motor end-plate, and the end-plate 7*b* at the opposite end of the tube is called second end-plate.

Figure 2:
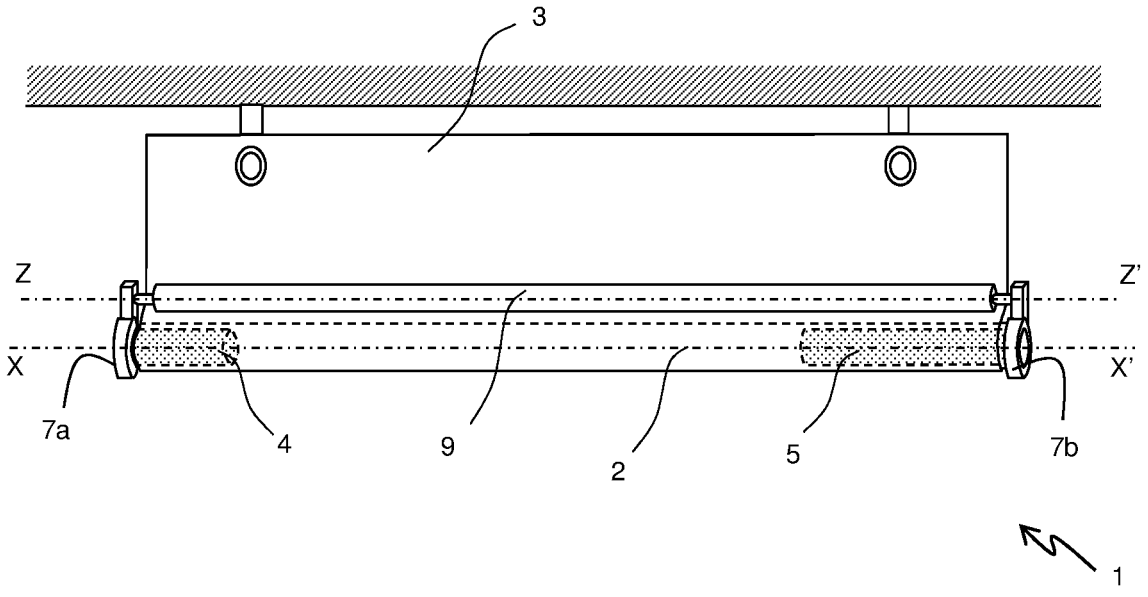
FIG. 2 is a representation of a second embodiment of a motorized home automation system for maneuvering a moving screen in an inverse-mounted configuration.

In a second embodiment represented in FIG. 2, the motorized screen system is intended to be linked to the structure of the building exclusively by the screen, that is to say that the motorized screen system is a system suspended by the screen and in which the winding tube is translated, notably is translated vertically, as the screen is wound or unwound. Thus, all the forces exerted on the system are taken up by the screen. Preferably, there is no other contact or link between the system and the building. The end-plates 7*a* and 7*b* are then used to hold the winding tube relative to the screen, notably by virtue of a rotation torque recovery bar 9 in contact with the screen and held between the end-plates in a direction Z-Z', parallel to the axis X-X'. The other references remain unchanged.

Figure 3:
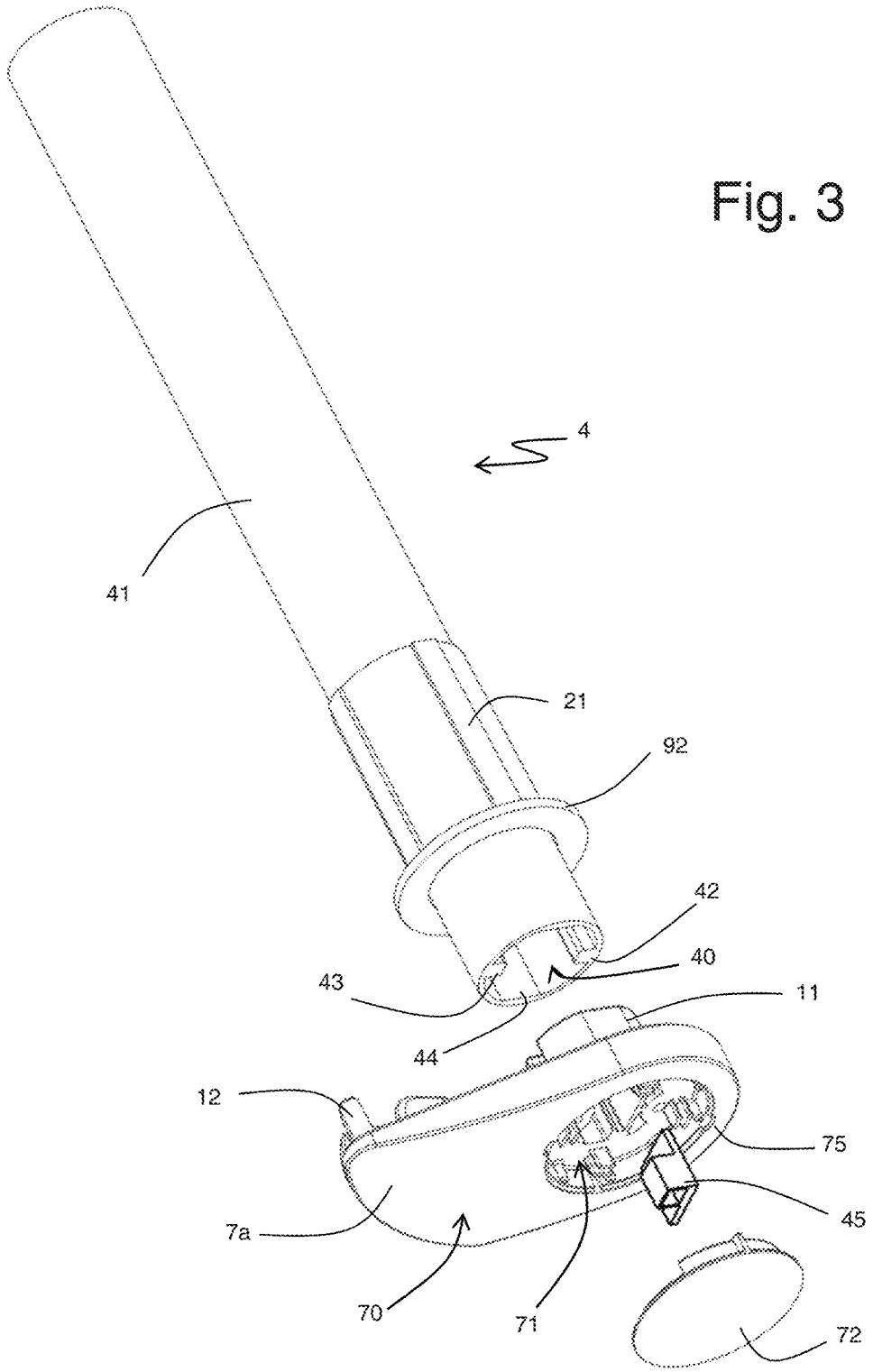
FIG. 3 represents, in an exploded view, a part of a motorized device for maneuvering a moving screen.
Figure 4:
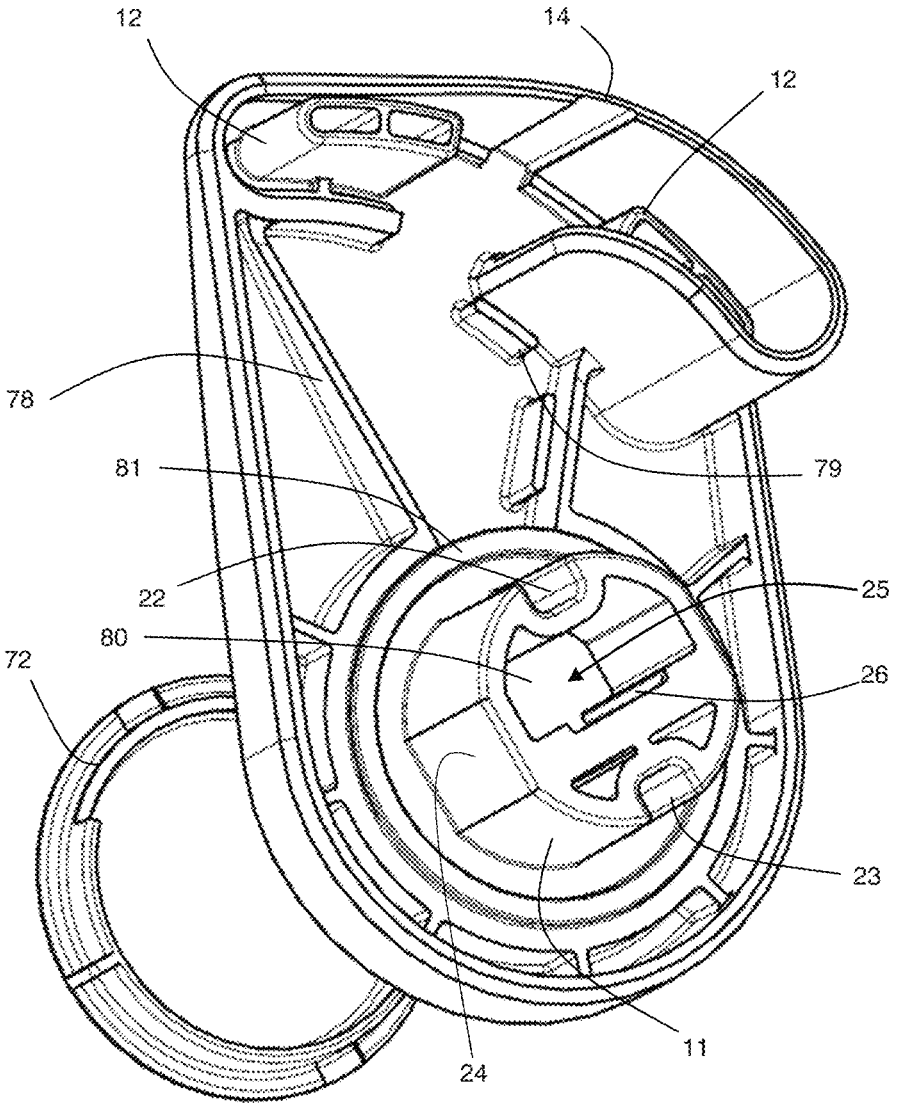
FIG. 4 represents, in perspective, a view of the inner face of an end-plate.

As represented in FIGS. 3 and 4, the actuator comprises a hollow housing 41, inside which are housed the electromechanical components such as the motor 4', the gear 4", the radio receiver, and the control electronics (not represented), etc.

The inner wall of the housing 40 has one or more ribs 42, 43, and planar areas 44. The planar areas can include a groove (not represented), allowing for the translational guidance of at least some of the electromechanical components, for example a printed circuit supporting the control electronics.

It should be noted that the tubular housing can comprise a closing cover (not represented), inserted into the housing to protect the electromechanical components of the actuator, and through which power supply wires enter. However, even in this case, the end of the housing is hollow.

A crown ring 21 with collar 92 is mounted to rotate freely on the housing. It serves as a bearing for the winding tube when the actuator is inserted into the tube.

The housing of the actuator is closed by the first end-plate 7*a*, a first support 11 of which cooperates with the hollow end of the housing of the actuator. In particular, the first support of the motor end-plate takes the form of a support shaft extending substantially at right angles to the end-plate on an inner face 71. The support shaft is provided with at least one longitudinal channel or groove 22, 23. The channels cooperate with the ribs 42, 43 formed on the inner walls of the housing of the actuator. The grooves-ribs assembly makes it possible both to guide the assembly of the housing on the support shaft and also to ensure the recovery of the rotational forces linked to the motor (torque recovery). The support shaft also comprises one or more flats 24, corresponding to the planar areas on the inner surface of the hollow housing, for this same purpose. The actuator is then slidingly mounted on the support shaft, before being translationally immobilized, if necessary, on the shaft or on the motor end-plate. Thus, the first support can comprise at least one first rotation stopping element, notably at least one groove 22, 23, respectively at least one rib, in particular at least one first rotation stopping element formed on a shafted part of the first support 11. Moreover, the housing 41 can comprise at least one second rotation stopping element 42, 43, notably at least one rib 42, 43, respectively at least one groove, in particular at least one second rotation stopping element formed on inner walls of the housing. The first and second rotation stopping elements advantageously cooperate to link in rotation, notably to link in rotation about the first longitudinal axis XX', the first support and the housing.

The motor end-plate and the tubular housing of the actuator are therefore directly linked, with no other intermediary. In particular, the actuator does not comprise any head, blocking the housing and serving as holding point. In other words, the head of the actuator is formed by the end-plate which also has a second support function, notably a support function for a torque neutralizing element or a support function for the home automation system.

The mounting thus saves in thickness: the motor end-plate itself takes up the rotational torque imparted by the actuator, by being directly connected to the hollow housing 41 or hollow body of the actuator. Thus, the winding tube and consequently the border of the fabric can be as close as possible to the inner face of the end-plate.

The support shaft is provided with a first bore 25 comprising, on its inner walls, at least one rail 26 forming a support and guiding element for an electronic control card 45 for the actuator. The latter is thus at least partially located inside the housing of the actuator when the latter is assembled on the support shaft and when the electronic card is slid along the rails inside the bore of the support shaft.

Advantageously, the bore in the support shaft is a through bore and the motor end-plate 7*a* also includes a through bore 71, forming an opening on the outer part 70 of the end-plate, that can be closed by a cover 72. This opening makes it possible to access in particular the electronic card without dismantling the rest of the system. In particular, the end-plate comprises notches 75, notably allowing for the passage of a tool, such as a flat screwdriver, to act, notably by a lever action, to raise the cover and access the electronic card.

The electronic card can also be provided with interface elements, for example a programming button, which can thus be accessed when the cover of the end-plate is removed, without dismantling the rest of the system. In maintenance situations, it is very simple to dismantle the system and disassemble the different parts.

The end-plate also comprises a second support element 12. The latter allows it to be fixed to a wall or a ceiling, in the first embodiment, or to the rotation torque recovery bar 9, in the second embodiment. In both embodiments, the second support element is distinct from the first support element and acts on a distinct axis.

In the first embodiment, the second support element comprises a foot which can be mounted on a wall or on a ceiling, by means of known elements such as screws, glue, magnets. The support (or the suspension) of the device on the frame is thus implemented in a direction Ya-Ya' at right angles to the axis of the winding tube X-X'.

In the example represented in FIG. 3, the second support element takes the form of a pin extending along an axis Z-Z' parallel to the axis of the first support. A number of pins can form the support element. The torque recovery bar is thus held between the second support element of the motor end-plate and the second end-plate.

The torque neutralizing element can have a hollow end whose internal diameter corresponds to that of the pin to be plugged therein and mechanically held.

In place of the torque recovery element, a connection element (not represented) can be mounted on the second support element in the form of a pin. This connection element makes it possible to mount the device on a wall or a ceiling, while using an identical or almost identical end-plate for the two embodiments. The connection element is, for example, a bent element.

Each lateral element 7, 7' produced in end-plate form also comprises the support elements mentioned, and elements 14 for masking and protecting the lateral parts of the winding, and possibly for guiding the latter in the case where an obstacle comes to modify the correct operation of the winding.

Figure 5:
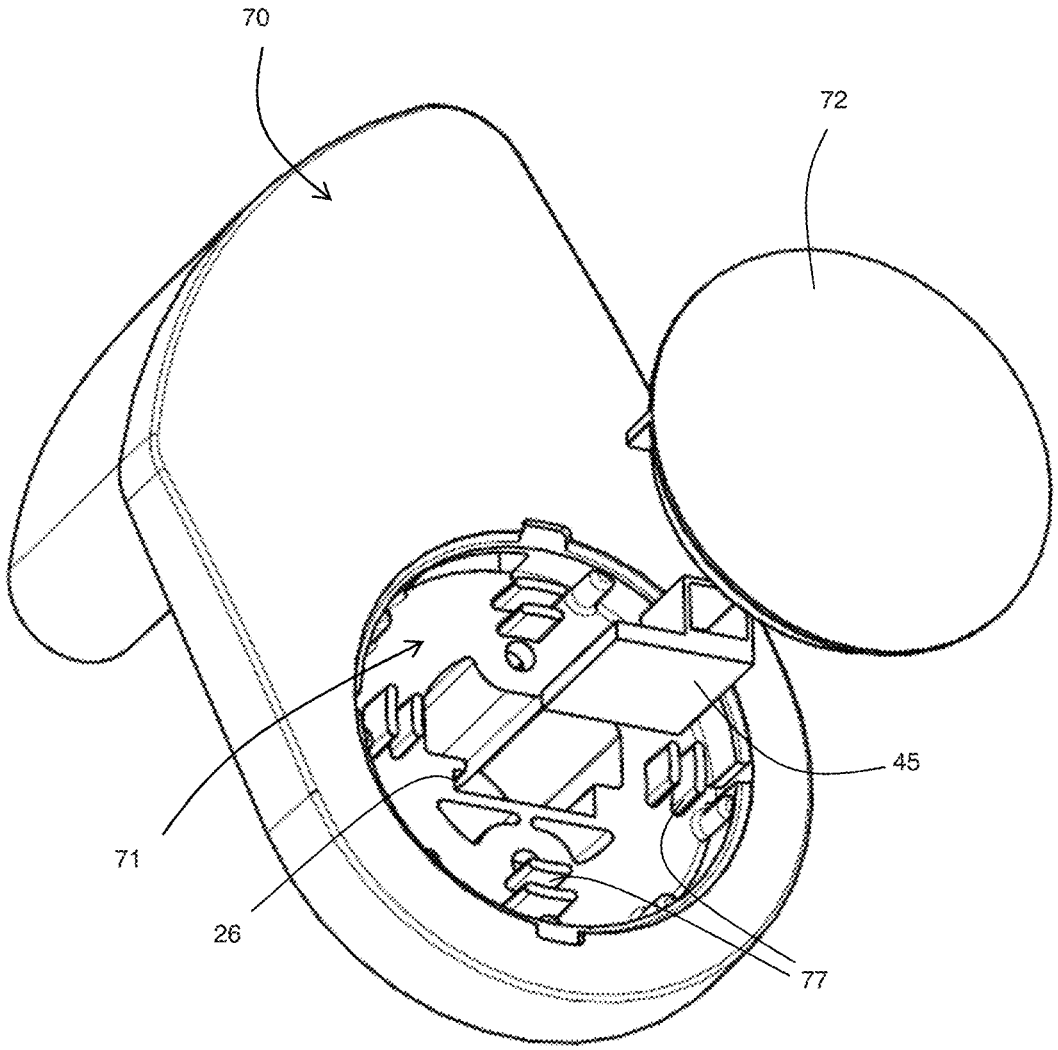
FIG. 5 represents, in perspective, a view of the outer face of the end-plate.
Figure 6:
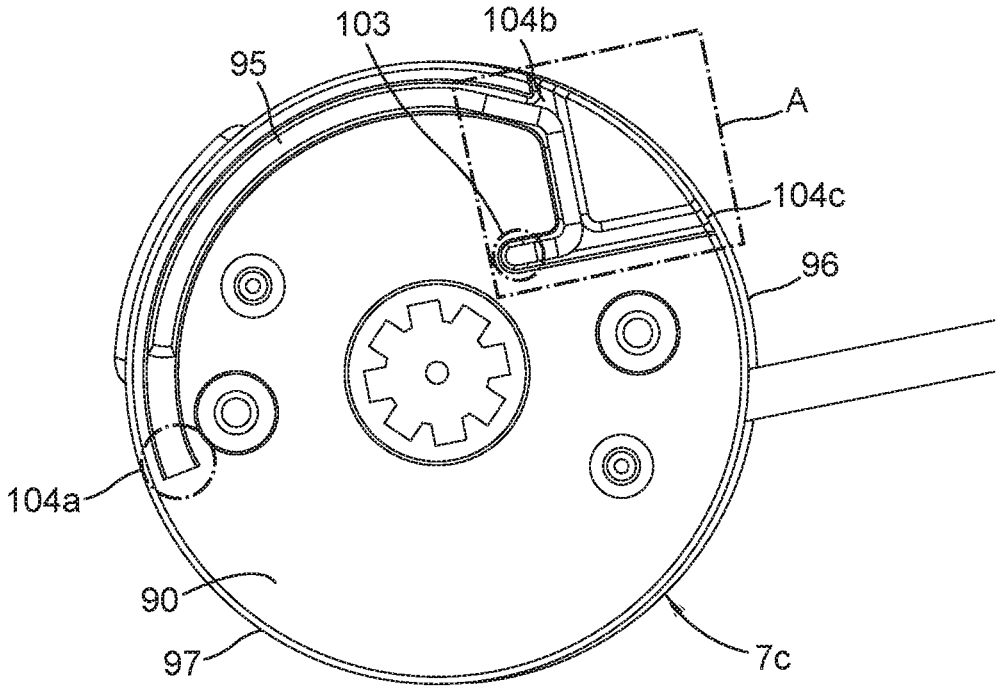
FIG. 6 represents a view of the outer face of the end-plate in a variant embodiment with a lid having an antenna groove.
Figure 7:
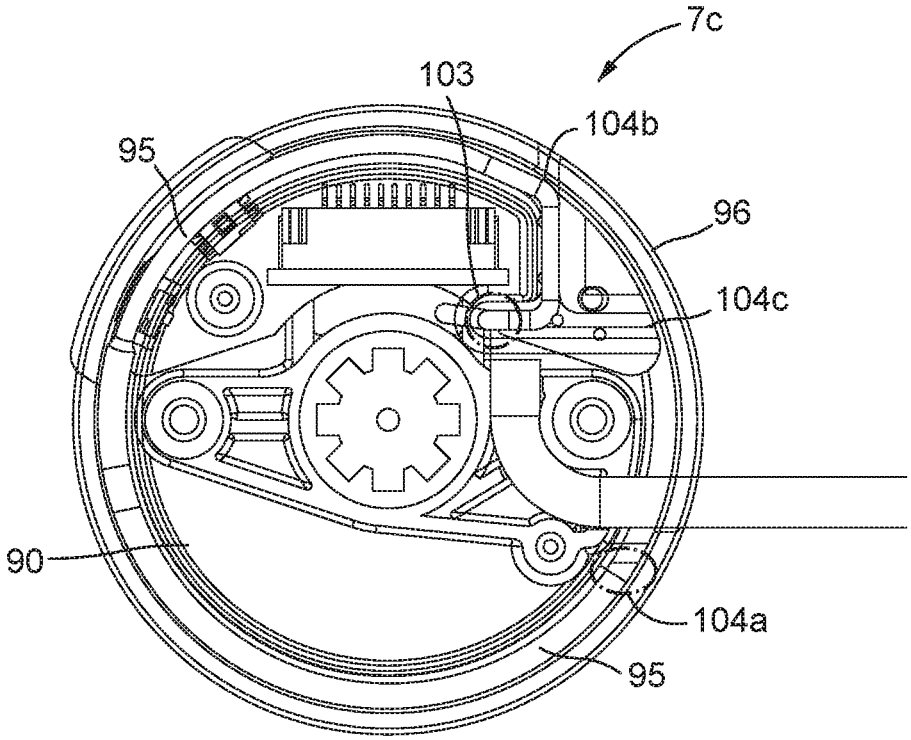
FIG. 7 represents a view of the outer face without lid in an alternative embodiment with longer antenna groove in the bore covered by the lid.
Figure 8:
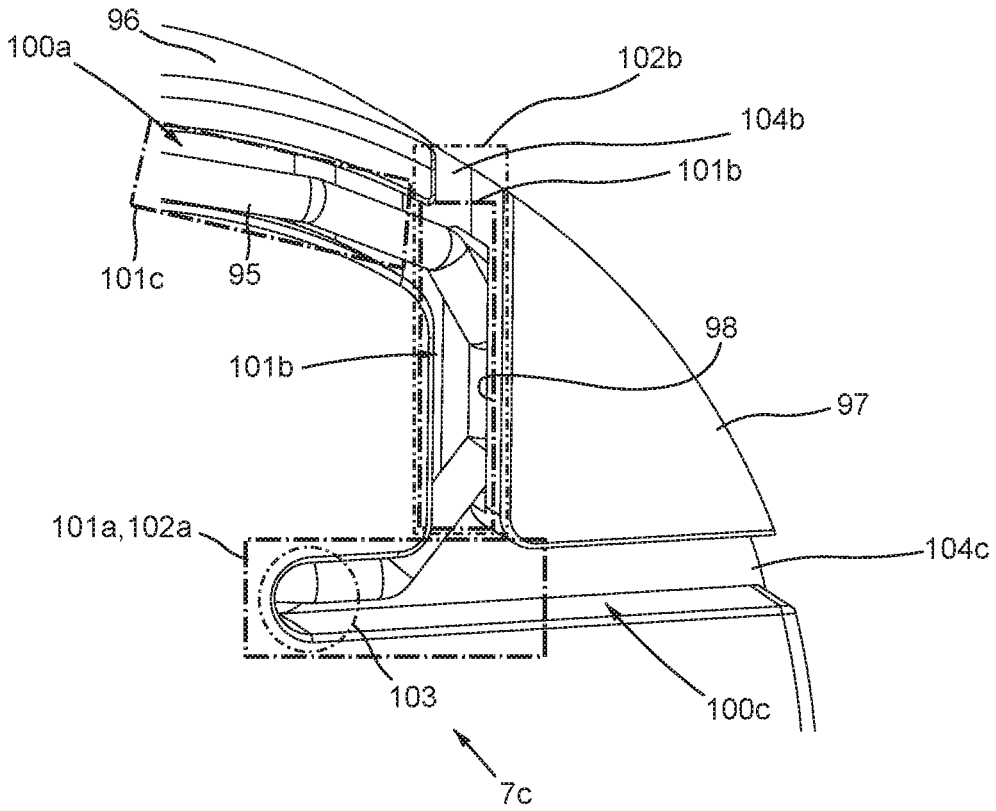
FIG. 8 represents a detailed view of area A of FIG. 6, with a slightly modified position of the antenna.
Figure 11:
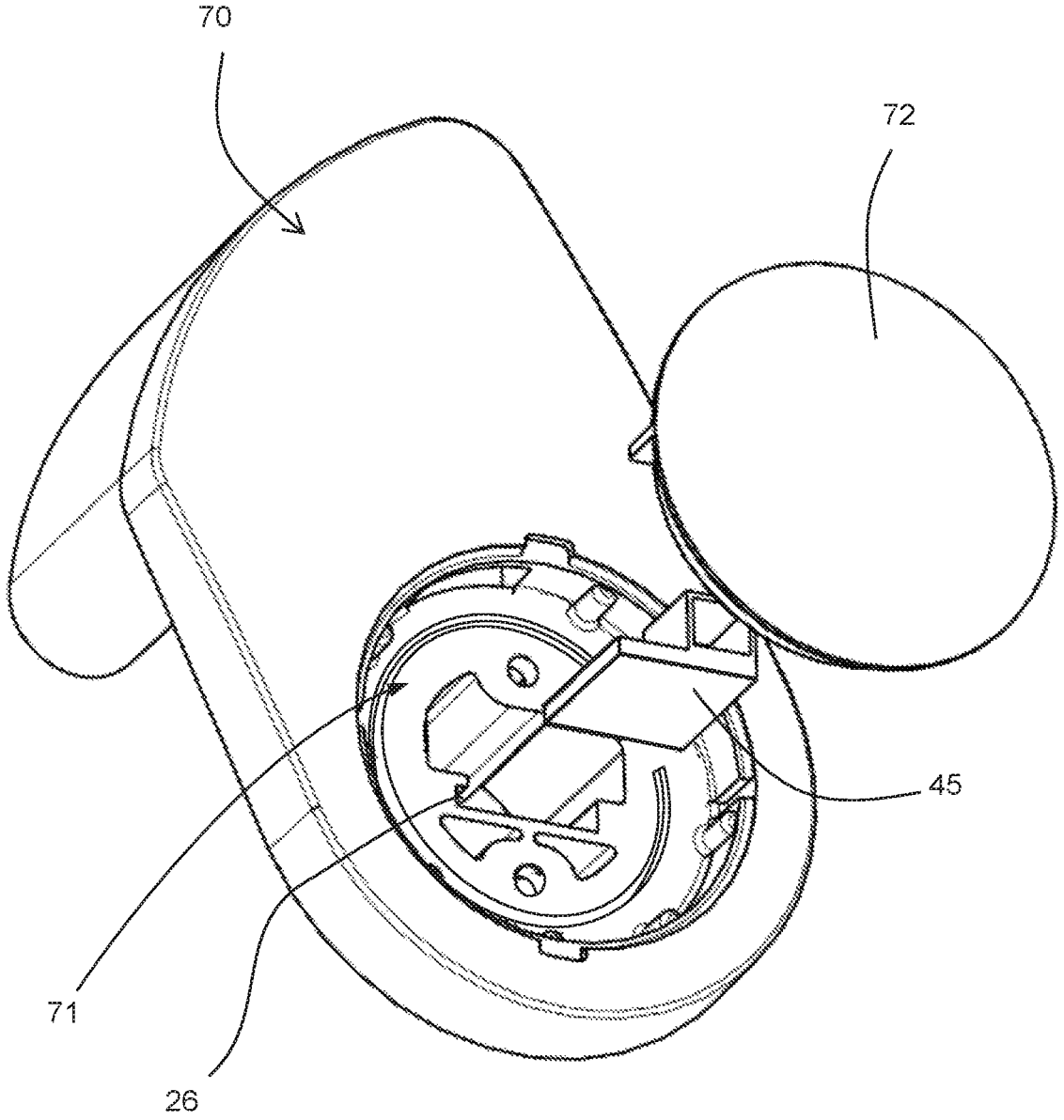
FIG. 11 is a perspective view of the outer face of the end-plate identical to FIG. 5, in a variant with a groove instead of pins on the bottom of the bore.

The motor end-plate also comprises, in the bore emerging on its outer face, a first guiding path 77 to store therein, for example, an antenna wire. This first guiding path can take the form of pins arranged facing one another and between which a part of the antenna cable can be wedged. As shown in FIG. 5, the bore has a side wall surrounding the bottom on which the pins are arranged, and a through hole emerging from the inner face of the end-plate into the bore. As shown in FIG. 11, the bore has a side wall surrounding the bottom in which a groove is arranged.

The inner face of the motor end-plate is hollowed and comprises, in addition to the reinforcing walls 78, also a second guiding path 79 between the first support element and the second support element. The inner face and the outer face are connected to one another, through a through hole 80 emerging from the inner face in the bore of the inner face. The through hole emerges outside the diameter of the housing of the actuator. This second guiding path makes it possible to accommodate a power supply wire (not represented), for example arriving along the torque recovery bar from the power supply device arranged at the other end of the winding tube, to the actuator, or arriving from a suspended ceiling along the second support. The power supply wire is then inserted through the through hole to the bore of the motor end-plate and can be connected to the electronic card or to the actuator through the bore of the support shaft.

The inner face of the end-plate also comprises an annular surface 81, on which, during mounting, the collar of the crown ring used as bearing bears on the winding tube. The surface condition and/or the small dimensions of this annular surface make it possible to minimize friction during operation.

One variant of the embodiments of the end-plate 7*c* is represented in FIGS. 6 to 10. This variant of the end-plate 7*c* may be carried out in the first and second embodiments of the invention. This end-plate 7*c* corresponds preferably to the head of the actuator, closing the hollow tubular housing 41 of the actuator. The actuator head is intended to be mounted on a supporting surface, as shown in the embodiments of FIGS. 1 and 2 or eventually on vertical surface such as a window or door posts, so as to support a motorized maneuvering device 1 for maneuvering a moving element.

This end-plate 7*c* is made of a circular plate which comprises an outer face 90 and an inner face 90*a* surrounded by a peripheral wall 96. The support 11 extends from the inner face 90*a* of the end-plate 7*c*. The support 11 is globally tubular and able to cooperate in form with the extremity of the hollow tubular housing of the actuator. It can be seen on FIG. 9 that the support 11 of the end-plate 7*c* extends substantially at right angle to the end-plate 7*c* from the inner face 90*a*. When the actuator head is mounted on the hollow tubular housing 41, the support 11 is inserted at least partially within the hollow tubular housing 41.

This end-plate 7*c* comprises on its outer face 90 at least one guiding path 100*a*, 100*b*, 100*c* formed by a groove and/or a hole in which a radio antenna 95 can be arranged. By "hole" is meant a cavity dug in the outer face 90 in order to receive or wedge a part of the antenna 95.

More specifically, the end-plate 7*c* includes two or three guiding paths: a first, a second and eventually a third guiding path 100*a*, 100*b*, 100*c*.

The first, second and third guiding paths 100*a*, 100*b*, 100*c* each comprise first and second ends 103, 104*a*, 104*b*, 104*c*. The first end 103 is common for these first, second and third guiding path 100*a*, 100*b*, 100*c*. In other words, the first, second and third guiding paths 100*a*, 100*b*, 100*c* have the same first end 103 which is situated near an antenna bore through which the antenna will pass from the electronic board inside the actuator hollow housing 41 to the outside. The second end 104*a* of the first guiding path 100*a* is situated in the outer face 90 of that end-plate 7*c*. Concerning the second and third guiding paths 100*b*, 100*c*, their second end 104*b*, 104*c* opens at an outer periphery or edge 97 of the end-plate 7*c*. More accurately, the second and third guiding paths 100*b*, 100*c* extend in the outer face 90 from their first end 103 to the outer periphery 97 of the outer face 90.

The first guiding path 100*a* extends along the outer face 90 from the first end 103 to the second end 104*a* and is divided into three parts 101*a*, 101*b*, 101*c*. The first part 101*a* comprises the first end 103 of the first guiding path 100*a*.

The second guiding path 100*b* extends in the outer face 90 from the first end 103 to its second end 104*b* and comprises two parts 102*a*, 102*b*. The first part 102*a* can be common with the first guiding path 100*a*, more precisely common to a constituting part of the first guiding path 100*a*. This first part 102*a* of the second guiding path is thus shared with the first guiding path 100*a*.

The third guiding path 100*c* of this end-plate 7*c* extends from the first end 103 to its second end 104*c*. This third guiding path 100*c* can be a groove preferably a rectilinear groove formed in the outer face 90. As already discussed, this third guiding path 100*c* may have portions common to the first and/or second guiding paths 100*a*, 100*b*.

The third guiding path preferably joins the outer periphery 97 of the outer face 90 in a direction orthogonal to the second guiding path 100*b*.

Figure 12:
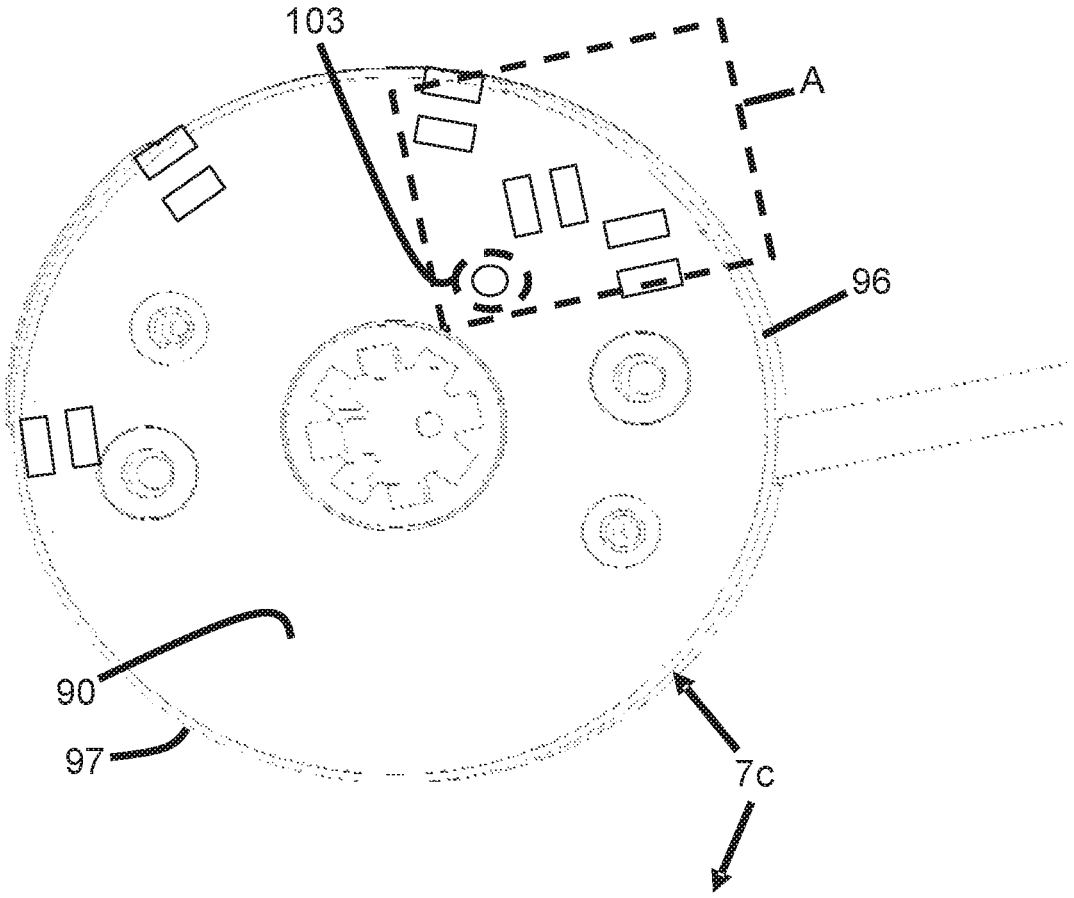
FIG. 12 is a view of the outer face of the end-plate identical to FIG. 6, in a variant embodiment with a lid having antenna paths made of pins instead of a groove.

The guiding paths 100*a*, 100*b*, 100*c* can be rectilinear or curved grooves or grooves formed from portion at angles with each other, in the outer face 90. The grooves can be at least partly opened or covered. The 20 guiding paths 100*a*, 100*b*, 100*c* can alternatively take the form of pins arranged facing one another as shown on FIG. 5. FIG. 12 shows a view of the outer face of the end-plate identical to FIG. 6, in a variant embodiment with a lid having antenna paths made of pins instead of a groove.

It is well understood that in other alternatives, the first, second and third guiding paths 100*a*, 100*b*, 100*c* may be formed by a combination of linear or curved, covered and opened grooves and/or pins.

In the end-plate 7*c*, the inner and outer faces 90*a*, 90 communicate through a through-hole emerging in the first, second and third guiding paths 100*a*, 100*b*, 100*c*, more precisely in the first end 103 of these guiding paths 100*a*, 100*b*, 100*c*.

As we previously said, the actuator 4 can comprise an antenna 95 which can be for example an antenna wire or cable 95. This antenna 95 has two ends, one connected to an electronic card situated for example in the tube or at least partly in the support shaft 11, and the other one which is a free end. The free end of the antenna 95 is adapted for passing through the through-hole such that the antenna 95 is mainly located outside the hollow tubular housing 41 of the actuator 4.

The free end of the antenna 95 can be arranged and/or wedged in the end-plate 7*c* in different configurations:

- a first configuration wherein the antenna 95 is placed in the first guiding path 100*a*, with preferably its free end arranged in the hole and a part of this antenna 95 wedged in the holder component 98;
- a second configuration wherein the antenna 95 can be arranged in the second guiding path 100*b*, with preferably the free end of this antenna 95 which juts out of the peripheral wall 96 going through the hole formed by the second end 104*b;*
- a third configuration wherein the antenna 95 can be arranged in the third guiding path 100*c*, with preferably the free end of this antenna 95 which juts out of the peripheral wall 96 going through the hole formed by the second end 104*c*.
- eventually a fourth configuration where the antenna extends freely from the outer face 90.

The arrangement of the antenna 95 in the end-plate 7*c* in one of the different configurations is chosen at wish, according to the context in which the motorized maneuvering device 1 including this variant embodiment of the end-plate 7*c* is used. For example it may be chosen according to the installation of the motorized maneuvering device 1 in a home automation system or motorized screen system.

Thus, the invention also relates to a method of configuring the motorized maneuvering device 1, the method comprising the following steps:

- Providing the motorized maneuvering device 1 comprising the end-plate 7*a* as previously disclosed and the radio antenna 95;
- Shaping and setting the radio antenna 95 in the first guiding path 100*a* or shaping and setting the radio antenna 95 in the second guiding path 100*b*, or eventually shaping and setting the radio antenna 95 in the third guiding path 100*c;*
- Eventually, the antenna can be shaped independently of any guiding path 100*a*, 100*b*, 100*c* and set freely in a first direction perpendicular to the end-plate outer plane.

Thus, the method of configuring the motorized maneuvering device 1 comprises the following steps:

- Providing the motorized maneuvering device 1;
- Removing the radio antenna 95 from the first guiding path 100*a* and shaping and setting the radio antenna 95 in a different configuration.

The last step of removing the radio antenna may also be implemented as follows:

- Removing the radio antenna 95 from the first guiding path 100*a* and shaping and setting the radio antenna 95 in the second guiding path 100*b* or in the third guiding path 100*c*.

Figure 10:
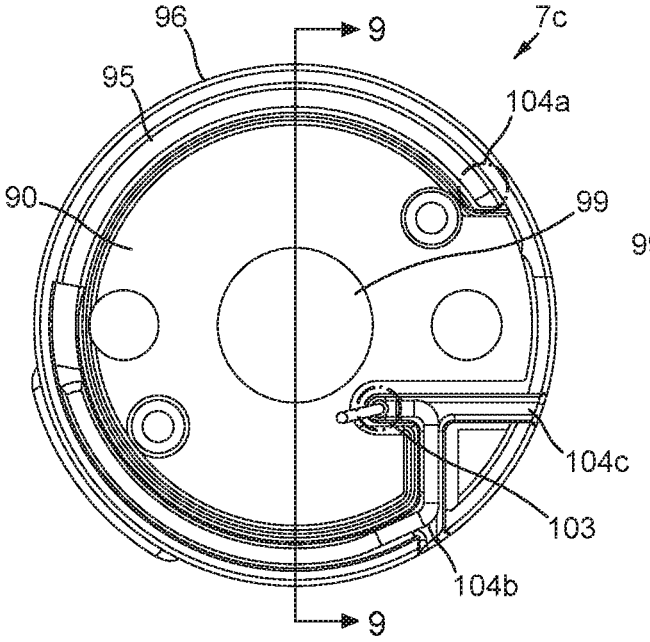
FIG. 10 represents a view of the outer face with a lid in a second alternative embodiment of a longer antenna groove in the lid.
Figure 9:
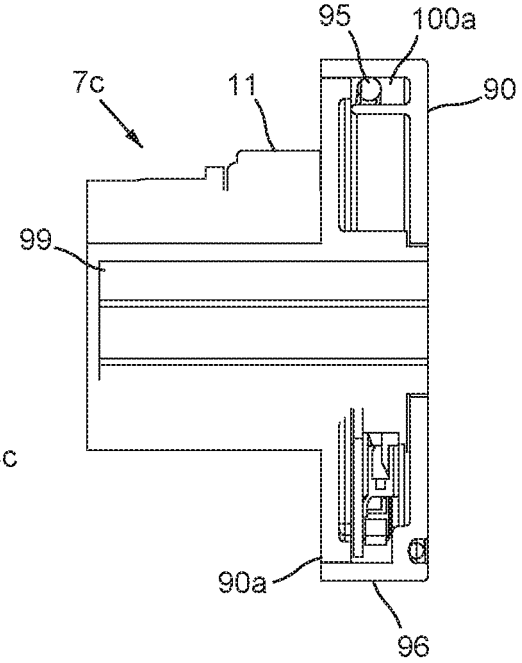
FIG. 9 represents a sectional view thereof taken along line 9-9 of FIG. 10.

When placed in the second path 100*b*, the antenna 95 extends in a second radial direction out of the end-plate 7*a*. When placed in the third path 7*c*, the antenna 95 extends in a third radial direction out of the end-plate 7*c*. The second radial direction and the third radial direction as represented are orthogonal but any other configuration may be possible. In all these configurations, the fact that the antenna 95 extends outside the actuator 4 improves the radio communication range of the actuator 4, especially in the case where the hollow tubular housing is metallic. In these two configurations, the fact that the antenna 95 extends partly freely out of the actuator 4 has a negative aesthetic impact but the operating range of the radio communication means is improved compared to when the antenna 95 is inside the hollow housing or shaped along the first guiding path 100*a*. FIG. 10 shows the central area 99 of the outer face 90 of the end-plate 7*c* being additionally covered.

When placed in the first path 100*a*, the antenna 95 is completely integrated in the actuator 4. This is very interesting as there is no fragile part that hangs out of the actuator 4. The antenna 95 is thus safely stored especially during manufacture and transport. Depending on the configuration of the installation of the actuator 4 on site, the antenna 95 might remain in the first guide path 100*a* and still allow sufficient radio communication range. If the operating range of the radio communication means is considered to be too weak for the installation, the antenna 95 can easily be deployed in the second guide path 100*b* or eventually in the third guide path 100*c* or freely deployed, so as to extend outside any closed metallic environment (roller tube, shutter box) which impairs the radio communication means.

With an end-plate 7*c* according to the invention, the user can give priority to a protection criterion (where the antenna is safely stored within the actuator end plate) or to an operational range criterion (where the antenna 95 is deployed to increase the radio communication range), and configure the antenna 95 of the actuator 4 accordingly.

The invention also applies in the context of a moving element that cannot be wound on the tube, for example a blind of inverted type, of folded or ruffled type, the beads of which are wound on a shaft driven by the actuator, for example on a tube containing the power supply device. It also applies in the context of a screen of hinged type (shutter or gate), the power supply device of which would be housed in an actuation tube, for example a tube positioned at the level of the hinge pins.

The invention claimed is:

1. An end-plate for a radio controlled motorized manoeuvring device, the end-plate comprising: an outer lateral face and an inner lateral face opposed to the outer lateral face, the inner lateral face of the end-plate being configured to be assembled with a hollow housing of an actuator along a first longitudinal axis, and, a first guiding path, wherein the first guiding path forms lateral sides facing each other and a bottom oriented in a direction opposite the inner lateral face of the end-plate, and is shaped for receiving and holding at least a part of a wire or antenna, the first guiding path being formed by at least one selected from the group consisting of (a) a first groove on the outer lateral face of the end-plate and (b) first pins on the outer lateral face of the end-plate, wherein a main direction of the first guiding path is along the outer lateral face of the endplate, wherein a shape of the first guiding path along the main direction of the first guiding path includes at least one selected from the group consisting of (i) a curved portion along the main direction of the first guiding path along the outer lateral face of the end-plate, and (ii) two adjacent portions at an angle with each other along the main direction of the first guiding path along the outer lateral face of the end-plate, wherein an end of the first guiding path is located near a bore connecting the outer lateral face to the inner lateral face of the end-plate, and wherein a wire or antenna is arranged in the bore connecting the outer lateral face to the inner lateral face of the end-plate and in the first guiding path along the outer lateral face of the end-plate, the wire or antenna being arranged in at least one selected from the group consisting of (i) the curved portion and (ii) the two adjacent portions at an angle with each other.

2. The end-plate according to claim 1, wherein the end-plate comprises a second guiding path formed by at least one selected from the group consisting of a second groove and second pins on the outer lateral face of the end-plate, and wherein the second guiding paths is shaped for receiving and holding at least a part of the wire or antenna.

3. The end-plate according to claim 2, wherein the first guiding path and the second guiding path have a first common end and second ends.

4. The end-plate according to claim 1, wherein the first guiding path comprises a part which extends in whole or in part along a perimeter of the outer lateral face.

5. Motorized manoeuvring device for manoeuvring a moving element, wherein the motorized manoeuvring device comprises:

the end-plate according to claim 1, a hollow housing for an actuator, wherein the end-plate and the hollow housing are assembled along the first longitudinal axis, and wherein the wire or antenna received in the first guiding path includes at least a part of a radio antenna.

6. Method of configuring a motorized manoeuvring device, the method comprising:

providing a motorized manoeuvring device for manoeuvring a moving element, the motorized manoeuvring device comprising the end-plate according to claim 1 wherein the wire or antenna comprises a radio antenna;

removing the radio antenna from the first guiding path and shaping and setting the radio antenna in a different configuration.

7. Method of configuring a motorized manoeuvring device, the method comprising:

providing a motorized manoeuvring device for manoeuvring a moving element, the motorized manoeuvring device comprising the end-plate according to claim 2 wherein the wire or antenna comprises a radio antenna;

removing the radio antenna from the first guiding path and shaping and setting the radio antenna in the second guiding path.

8. The end-plate according to claim 1, wherein the first guiding path is formed by a first groove.

9. The end-plate according to claim 2, wherein the second guiding path is formed by a second groove.

10. The end-plate according to claim 3, wherein the first guiding path and the second guiding path extend at least partially in different directions, so that at least a part of the second guiding path branches out in a substantially different direction relative to the first guiding path.

11. The end-plate according to claim 1, wherein the first guiding path extends in whole or in part along at least a quarter of a perimeter of the outer lateral face.

12. The end-plate according to claim 1, wherein the wire or antenna includes at least a part of a radio antenna.

13. The end-plate according to claim 1, wherein the wire or antenna includes at least a part of an electrical wire.

14. The motorized manoeuvring device according to claim 5, wherein the end-plate comprises a second guiding path in at least one selected from the group consisting of (i) the inner face and (ii) a bore that opens on the outer face of the end-plate, and wherein the second guiding path receives and holds at least a part of an electrical wire.

15. Motorized manoeuvring device for manoeuvring a moving screen, the motorized manoeuvring device comprising:

an actuator, comprising a hollow housing containing a motor and a gear, a mounting end-plate, wherein the end-plate comprises an outer lateral face and an inner lateral face opposed to the outer lateral face, and a first support extending from the inner lateral face of the end-plate along a first longitudinal axis, the hollow housing of the actuator being assembled with the end-plate so as to be closed by the first support, wherein the end-plate comprises:

a bore having a first end that opens on the outer lateral face of the end-plate and a second end that forms a bottom recessed from the outer lateral face of the end-plate, the bore having a side wall surrounding the bottom and a through hole emerging from the inner face of the end-plate into the bore, and in the bore, a first guiding path, wherein the first guiding path has lateral sides facing each other, the lateral sides being formed by the at least one selected from the group consisting of a groove and pins, and a bottom oriented in a direction opposite the inner lateral face of the end-plate, the first guiding path being formed by at least one selected from the group consisting of a groove and pins adapted for receiving and holding at least a pail of a wire or antenna, wherein a main direction of the first guiding path is along the bottom of the bore, and wherein the wire or antenna is arranged in the through hole emerging from the inner face of the end-plate into the bore and in the first guiding path, the wire or antenna being arranged between the lateral sides facing each other of the first guiding path.

16. Motorized device according to claim 15, wherein the first support comprises at least one first rotation stopping element and the hollow housing comprises at least one second rotation stopping element, the first rotation stopping element and the second rotation stopping element cooperating to link in rotation, the first support and the hollow housing.

17. Motorized device according to claim 15, wherein the actuator comprises a radio receiver and the wire or antenna includes an antenna wire of the radio receiver.

18. Motorized device according to claim 17, wherein the first guiding path takes the form of pins arranged facing one another and between which a part of the antenna wire is wedged.

19. Motorized device according to claim 15, wherein the end-plate comprises a cover adapted to close the bore that opens on the outer lateral face.

20. Motorized device according to claim 15, wherein the actuator comprises electromechanical components inside the hollow housing.

21. Motorized device according to claim 15, wherein the end-plate comprises another bore intended to receive at least one selected from the group consisting of (i) a connection and (ii) an electronic part of the actuator, said other bore being formed inside the first support.

22. Motorized device according to claim 21, wherein the bore that opens on the outer lateral face of the end-plate and the other bore formed inside the first support are connected to one another.

23. Motorized device according to claim 21, wherein the end-plate comprises a through hole between the other bore produced inside the first support and the inner lateral face of the end-plate for entry of a cable.

24. Motorized device according to claim 15, which comprises an annular surface on the inner lateral face of the end-plate, wherein the annular surface is configured to allow a bearing ring mounted free in rotation about the hollow housing of the actuator to bear against the annular surface.

25. Motorized device according to claim 15, wherein the first support cooperates with the hollow housing of the actuator, and wherein the motorized device comprises a second support extending from the end-plate along a second axis distinct from the first longitudinal axis.

26. A motorized home automation system comprising: the motorized device according to claim 15, a bearing ring rotating freely on the housing of the actuator, a winding tube, mounted to slide on the bearing ring, wherein the bearing ring bears on the inner lateral face of the end-plate, a second end-plate comprising a winding tube support element, a radio-receiver, and a power supply device of the actuator comprising an electrical energy storage element.

27. The motorized home automation system according to claim 26, wherein the maneuvering actuator is inserted into one end of the winding tube, and the power supply device is inserted into another end of the winding tube.

28. The motorized home automation system according to claim 26, wherein the end-plate is fixed onto an accessory, wherein the accessory is added onto a frame or on a side of a casing.

29. The motorized manoeuvring device according to claim 15, wherein the wire or antenna includes at least a part of a radio antenna.

30. The motorized manoeuvring device according to claim 15, wherein the wire or antenna includes at least a part of an electrical wire.

* * * * *